US009739560B1

(12) United States Patent
Salvador

(10) Patent No.: US 9,739,560 B1
(45) Date of Patent: Aug. 22, 2017

(54) SYSTEM, METHOD AND APPARATUS FOR ATTACHING AN ACCESSORY TO A FIREARM

(71) Applicant: Joe Salvador, Wilbraham, MA (US)

(72) Inventor: Joe Salvador, Wilbraham, MA (US)

(73) Assignee: DAVINCI ARMS, LLC, Wilbraham, MA (US)

( * ) Notice: Subject to any disclaimer, the term of this patent is extended or adjusted under 35 U.S.C. 154(b) by 0 days.

(21) Appl. No.: 15/049,276

(22) Filed: Feb. 22, 2016

(51) Int. Cl.

| | |
|---|---|
| ***F41A 21/32*** | (2006.01) |
| ***F41A 21/34*** | (2006.01) |
| ***F41A 21/36*** | (2006.01) |
| ***F41A 21/30*** | (2006.01) |

(52) U.S. Cl.
CPC ..... *F41A 21/325* (2013.01); *F41A 21/30* (2013.01); *F41A 21/34* (2013.01); *F41A 21/36* (2013.01)

(58) Field of Classification Search
CPC ..... F41A 21/00; F41A 21/30; F41A 21/32; F41A 21/325
See application file for complete search history.

(56) References Cited

U.S. PATENT DOCUMENTS 1,413,024 A 4/1922 Harrell
3,917,373 A 11/1975 Peterson
4,893,426 A * 1/1990 Bixler ..... F16B 7/20 403/299
5,188,398 A * 2/1993 Parimore, Jr. ..... F16L 19/005 285/330
5,773,746 A 6/1998 Vaden
5,851,035 A * 12/1998 Marc ..... F16L 19/005 285/86
D577,409 S * 9/2008 Brittingham ..... D22/108
7,610,710 B2 11/2009 Brittingham
7,661,349 B1 * 2/2010 Brittingham ..... F41A 21/30 181/223
7,743,693 B1 * 6/2010 Brittingham ..... F41A 21/325 89/14.2
7,905,170 B1 * 3/2011 Brittingham ..... F41A 21/325 89/14.2

(Continued)

OTHER PUBLICATIONS

International Search Report Dated May 20, 2016.

*Primary Examiner* — Derrick Morgan
(74) *Attorney, Agent, or Firm* — Grogan, Tuccillo & Vanderleeden, LLP

(57) ABSTRACT

A system for attaching an accessory to a firearm includes a muzzle device configured for attachment to the muzzle end of the firearm, the muzzle device having a first coarse-threaded engagement means and one of an annular grooved surface and a grooved surface engagement mechanism, and an adapter device. The adapter device includes an adapter having a forward portion including an accessory engagement means for receiving the accessory and a rearward portion having a second coarse-threaded engagement means formed on an inner surface of the adapter, a biasing mechanism received on the rearward portion, and a retainer ring received on the rearward portion adjacent to the biasing mechanism, the retainer ring having the other of the annular grooved surface and the grooved surface engagement mechanism. The male coarse-threaded engagement means and the female coarse-threaded engagement means cooperate to releasably secure the adapter device to the muzzle device.

15 Claims, 3 Drawing Sheets

(56) References Cited

U.S. PATENT DOCUMENTS

| | | | | |
|---|---|---|---|---|
| 8,490,535 | B1 | 7/2013 | Moore et al. | |
| 8,763,510 | B2 * | 7/2014 | Dueck | F41A 21/26 89/14.4 |
| 9,099,807 | B2 * | 8/2015 | Opgenorth | H01R 13/622 |
| 9,121,656 | B1 * | 9/2015 | McKenzie | F41A 21/30 |
| 9,440,246 | B2 * | 9/2016 | Meehan | B05B 1/00 |
| 9,500,427 | B1 * | 11/2016 | Larue | F41A 21/30 |
| 9,513,078 | B1 * | 12/2016 | Fulton | F41A 21/325 |
| 2006/0060076 | A1 * | 3/2006 | Dueck | F41A 21/30 89/14.4 |
| 2008/0156183 | A1 | 7/2008 | Brittingham | |
| 2010/0139145 | A1 * | 6/2010 | Brittingham | F41A 21/325 42/90 |
| 2010/0229712 | A1 * | 9/2010 | Graham | F41A 21/34 89/14.2 |
| 2012/0103176 | A1 | 5/2012 | Latka | |
| 2012/0180623 | A1 * | 7/2012 | Graham, II | F41A 21/325 89/14.4 |
| 2013/0180150 | A1 * | 7/2013 | Dueck | F41A 21/325 42/90 |
| 2014/0020976 | A1 * | 1/2014 | Shults | F41A 21/30 181/223 |
| 2014/0237881 | A1 * | 8/2014 | Mack | F41A 21/325 42/90 |
| 2014/0360807 | A1 | 12/2014 | McKenzie | |
| 2015/0260472 | A1 * | 9/2015 | Smith | F41A 21/30 89/14.2 |
| 2016/0370141 | A1 * | 12/2016 | Sy | F41A 21/36 |

* cited by examiner

SYSTEM, METHOD AND APPARATUS FOR ATTACHING AN ACCESSORY TO A FIREARM

CROSS-REFERENCE TO RELATED APPLICATIONS

This application claims the benefit of U.S. Provisional Application Ser. No. 62/120,189, filed on Feb. 24, 2015, which is herein incorporated by reference in its entirety.

FIELD OF THE INVENTION

The present invention relates generally to firearms and, more particularly, to a system, method and apparatus for quickly attaching various accessories to the muzzle of a firearm.

BACKGROUND OF THE INVENTION

Various systems and methods have been developed for use in the attachment of accessories to the muzzle of a firearm. These accessories may include silencers, flash suppressors, rocket and/or grenade launchers, line launchers, and the like. The reliability of the connection of the muzzle accessory and muzzle, and the ease or quickness with which the accessory is secured and removed, tend to provide competing objectives. For example, large numbers of fine threads and locking pins typically provide a very reliable connection but require a relatively long amount of time to secure or remove and may require the use of special tools. This is particularly undesirable in certain situations where quick attachment/detachment of an accessory is critical to operational or tactical effectiveness.

In addition to providing a sufficiently secure, yet readily releasable connection, for many types of accessories it is also important that the accessory is properly aligned with the barrel and firing axis of the firearm. This holds particularly true for silencers/sound suppressors where it is necessary to reduce the likelihood of a projectile making contact with any part of the silencer.

In view of the above, there is a need for a system, method and apparatus that provides for both a connection between a firearm and a muzzle accessory that is reliable and secure and which maintains alignment between the bore of the firearm and the bore of the accessory such as a silencer or suppressor, and which also allows for the accessory to be quickly and easily attached and detached from the firearm.

SUMMARY OF THE INVENTION

It is an object of the present invention to provide a system, method and apparatus for attaching an accessory to a firearm.

It is another object of the present invention to provide a system for attaching a suppressor or silencer to the muzzle of a firearm.

It is another object of the present invention to provide a system for reliably and securely attaching a suppressor or silencer to the muzzle of a firearm.

It is another object of the present invention to provide a system for quickly and easily attaching a suppressor or silencer to the muzzle of a firearm.

It is another object of the present invention to provide a system for attaching a suppressor or silencer to the muzzle of a firearm and which ensures alignment between a bore of the firearm and a bore of the silencer.

It is another object of the present invention to provide a system for attaching a suppressor or silencer to the muzzle of a firearm which prevents a biasing mechanism of the system from being exposed to heat cycling when not in use.

These and other objects are achieved by the present invention.

According to one embodiment of the present invention, a system for attaching an accessory to the muzzle end of a firearm is provided. The system includes a muzzle device configured for attachment to the muzzle end of the firearm, the muzzle device having a first coarse-threaded engagement means and one of an annular grooved surface and a grooved surface engagement mechanism, and an adapter device. The adapter device includes an adapter having a forward portion including an accessory engagement means for receiving the accessory and a rearward portion having a second coarse-threaded engagement means formed on an inner surface of the adapter, a biasing mechanism received on the rearward portion, and a retainer ring received on the rearward portion adjacent to the biasing mechanism, the retainer ring having the other of the annular grooved surface and the grooved surface engagement mechanism. The male coarse-threaded engagement means and the female coarse-threaded engagement means cooperate to releasably secure the adapter device to the muzzle device.

According to another embodiment of the present invention, an apparatus for attaching an accessory to a firearm includes an adapter having a generally cylindrical body having a forward portion including an accessory engagement means for receiving the accessory, and a rearward portion having a coarse-threaded engagement means formed on an inner surface thereof, a retainer ring received on the rearward portion and having one of an annular grooved surface and a grooved surface engagement mechanism, and a biasing mechanism received on the rearward portion intermediate accessory engagement means and the retainer ring, the biasing mechanism being configured to bias the retainer ring away from the forward portion.

According to yet another embodiment of the present invention, a method for attaching an accessory to a firearm includes securing a muzzle device to a barrel of a firearm and securing the accessory to an adapter device. The muzzle device includes a first coarse-threaded engagement means and one of an annular grooved surface and a grooved surface engagement mechanism. The adapter device includes a generally cylindrical body having a rearward portion having a second coarse-threaded engagement means formed on an inner surface of the body, a biasing mechanism received on the rearward portion, and a retainer ring received on the rearward portion adjacent to the biasing mechanism, the retainer ring having the other of the annular grooved surface and the grooved surface engagement mechanism.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
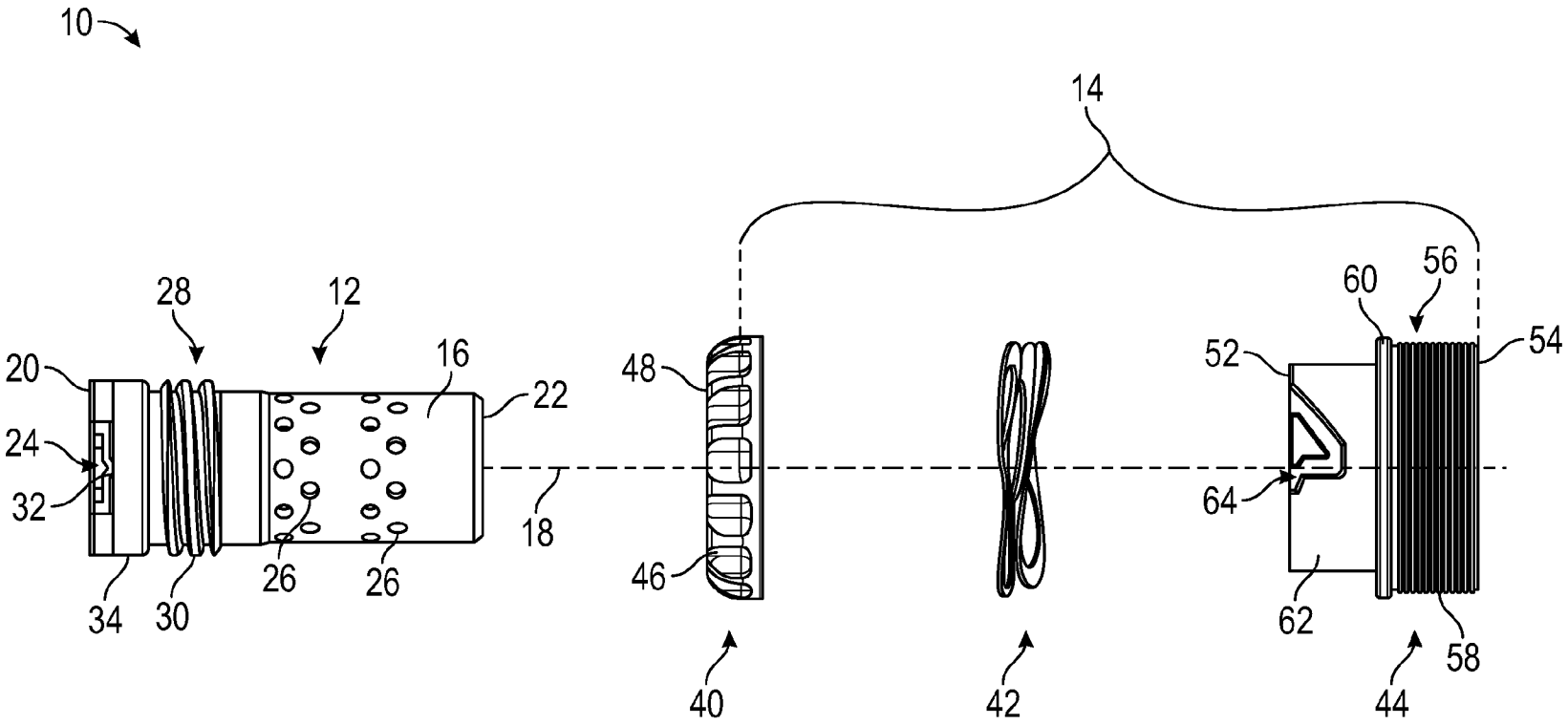
FIG. 1 is an exploded, side elevational view of a system for attaching an accessory to the muzzle of a firearm, according to an embodiment of the present invention.

Referring to FIG. 1, a system 10 for attaching an accessory to the muzzle of a firearm is shown. The system 10 includes a muzzle device 12, such as a flash suppressor, muzzle brake or muzzle compensator that is secured to the barrel of a firearm (not shown), and an adapter apparatus 14 configured to facilitate the quick attachment and detachment of an accessory to the muzzle device 12. The muzzle device 12 may be secured to the firearm barrel such as by welding or other conventional securement means (for example, by means of mating threads externally about the barrel muzzle and internally of the muzzle device 12 together with a high temperature cement or a locking device for preventing rotation of the installed muzzle device 12 with respect to the firearm barrel). The firearm barrel, to which the muzzle device 12 is secured, is not shown for purposes of clarity of description.

The muzzle device 12 is formed as a generally cylindrical body 16 concentric to a firing axis 18 of the firearm, and having a first end 20 and a second end 22. A muzzle engagement portion 24 extends into the body 16 at the first end 20 and is configured to engage the muzzle end of the firearm barrel in the manner described above. The muzzle device 12 defines a bore therethrough (not shown), concentric to the firing axis 18, for the passage of a projectile. The body 16 of the muzzle device 12 preferably includes a plurality of perforations or apertures 26, as known in the art.

Figure 3:
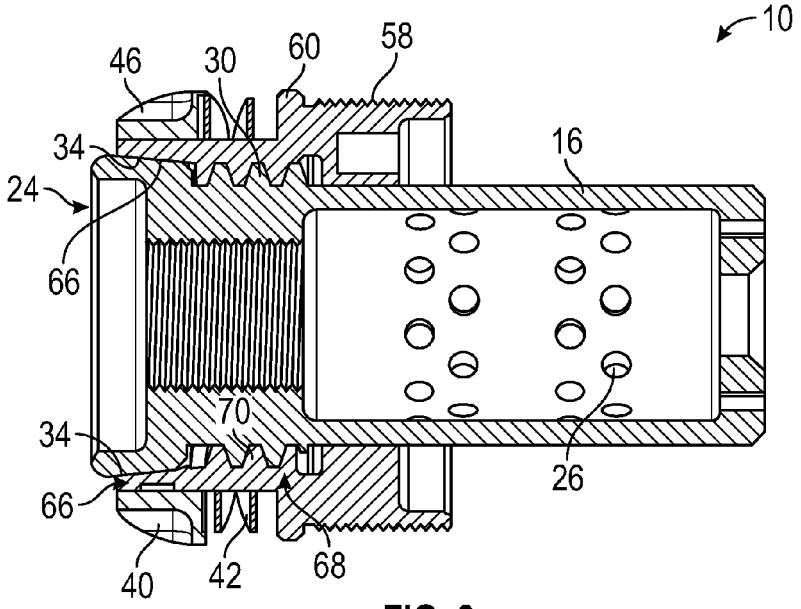
FIG. 3 is a cross-sectional view of the system of FIG. 1, showing a fully assembled position.

As further illustrated in FIG. 1, the muzzle device 12 is formed with a first engagement means 28 having a male coarse-threaded portion 30 adjacent to the first end 20. The muzzle device 12 also includes a grooved surface engagement mechanism, such as a pair of opposed teeth or projections 32, intermediate the first engagement means 28 and the first end 20 that extend forwardly towards the second end 22, the purpose of which will be discussed in detail hereinafter. As best shown in FIG. 3, the muzzle device further includes a tapered, peripheral surface 34 just rearward of the male coarse-threaded portion 30.

With further reference to FIG. 1, the adapter apparatus 14 of the system 10 includes a ratchet retainer ring 40, a spring 42 and a threaded adapter 44. The ratchet retainer ring 40 includes a generally annular body having an outwardly facing gripping portion 46 and rearwardly-facing, annular grooved surface 48 having a plurality of grooves 50. The annular grooved surface 48 surrounds the passageway defined by the annular body. The ratchet retainer ring 40 also includes a plurality of tabs or lugs (not shown) that extend radially inward from an inner surface of the retainer ring 40. In an embodiment, there are three lugs equally spaced about an inner periphery of the retainer ring 40.

The threaded adapter 44 defines a generally cylindrical body having a first end 52 and a second end 54, and is formed with an accessory engagement means 56 having a male fine-threaded portion 58 that extends from the second end 54 to a shoulder 60. The threaded portion 58 is configured to mate with a corresponding female-threaded portion of a firearm accessory (not shown) such as a sound suppressor or silencer. In particular, threaded portion 58 facilitates the secure attachment of a firearm accessory to the adapter 44 at the second end 54.

As further shown in FIG. 1, rearward of the shoulder 60 of the adapter 44 is a generally cylindrical rearward portion 62 having a plurality of channels 64 formed therein. In a embodiment, there are three channels 64 equally spaced about the rearward portion 62. The channels 64 are generally L-shaped and are configured to receive the lugs of the retainer ring 40 therein, as discussed in detail hereinafter. Importantly, a distal end of the channels 64 include a leg that extends generally parallel to the firing axis 18.

Figure 4:
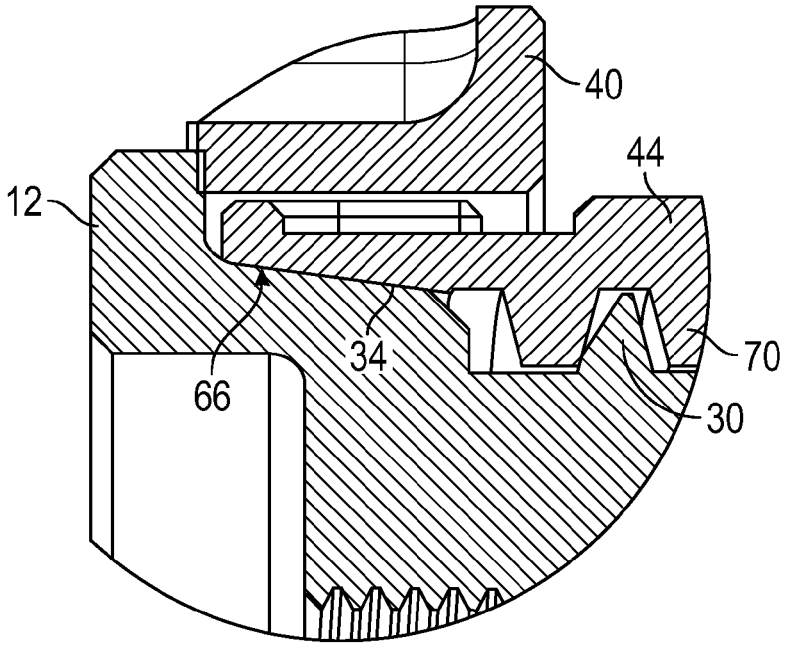
FIG. 4 is a an enlarged, cross-sectional view of a tapered lock portion of the system of FIG. 1.

As best shown in FIGS. 3 and 4, the interior of rearward portion 62 of the adapter 44 adjacent to the first end 52 includes a tapered surface 66 that is configured to mate with the tapered surface 34 of the muzzle device 12. In addition, the interior of the rearward portion 62 forward of the tapered surface 66 is formed with a second engagement means 68 having a female coarse-threaded portion 70 that is configured to mate with the male coarse-threaded portion 28 of the muzzle device 12.

In an embodiment, the spring 42 is a biasing means that resides intermediate the ratchet retainer ring 40 and the shoulder 60 of the adapter 44, and is disposed about the cylindrical rearward portion 62 of the adapter 44. In an embodiment, the spring 42 is a wave spring, although other types of springs or biasing mechanisms may also be utilized with departing from the broader aspects of the present invention.

Figure 2:
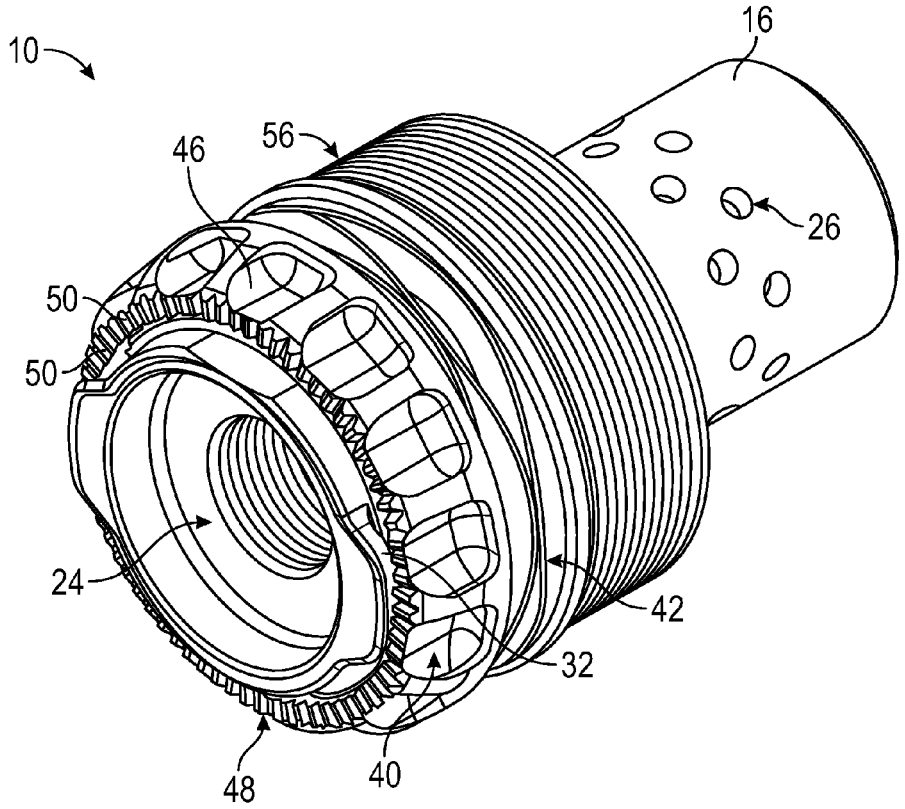
FIG. 2 is a perspective view of the system of FIG. 1, showing a fully assembled position.

In operation, the muzzle device 12 is secured to the muzzle of a firearm, in the manner discussed above and/or any manner known in the art. The adapter apparatus 14 is assembled by placing the wave spring 42 over the cylindrical rearward portion 62 of the adapter 44 until it abuts the shoulder 60, and then aligning the lugs of the ratchet retainer ring 40 with the channels 64 formed in the adapter 44. The retainer ring 42 and the adapter 44 are then pushed together and rotated relative to one another to seat the lugs within the proximal portions of the channels 64, which serves to selectively lock the ratchet retainer ring 40, spring 42 and adapter 44 together to form the adapter apparatus 14. A silencer, sound suppressor or other accessory may then be selectively attached to the adapter apparatus 44 by engaging a fine threaded portion of the accessory with the fine threaded portion 58 of the adapter 44. While FIGS. 1-3 illustrate the use of fine threads to attach an accessory to the adapter 44, other attachment mechanisms, such as a quick-disconnect, welded joint or the like may be utilized without departing from the broader aspects of the present invention.

In an embodiment the accessory may first be attached to the adapter prior to assembling the ratchet retainer ring 40 and wave spring 42. Utilizing this manner of assembly, the channels 64 in the adapter 44 may be engaged by a specialized tool or wrench to apply torque to assemble (or disassemble) the adapter 44 from the accessory. Once attached to the accessory, the wave spring 42 and retainer ring 40 can be assembled to the accessory mount 44.

In an embodiment, the adapter apparatus 14 may be attached to any accessory that a user elects to carry or use. When a user desires to attach the accessory to a firearm having the muzzle device 12 installed thereon, a user simply slides the adapter apparatus 14 (having the accessory already attached thereto) over the cylindrical body 16 of the muzzle device 12. The body 16 of the muzzle device 12 is therefore received through the internal passage defined by the ratchet retainer ring 40 and adapter 44, and may protrude from the second end 54 of the adapter 44 as shown in FIG. 2 (and into the accessory).

In particular, the adapter apparatus 14 and accessory are slid over the muzzle device 12 until the female coarse-threaded portion 70 of the adapter 44 abuts the male coarse-threaded portion 30 of the muzzle device 12. The adapter apparatus 14 and accessory are then rotated about the firing axis 18 to inter-engage the male and female coarse-threaded portions 30, 70.

Figure 5:
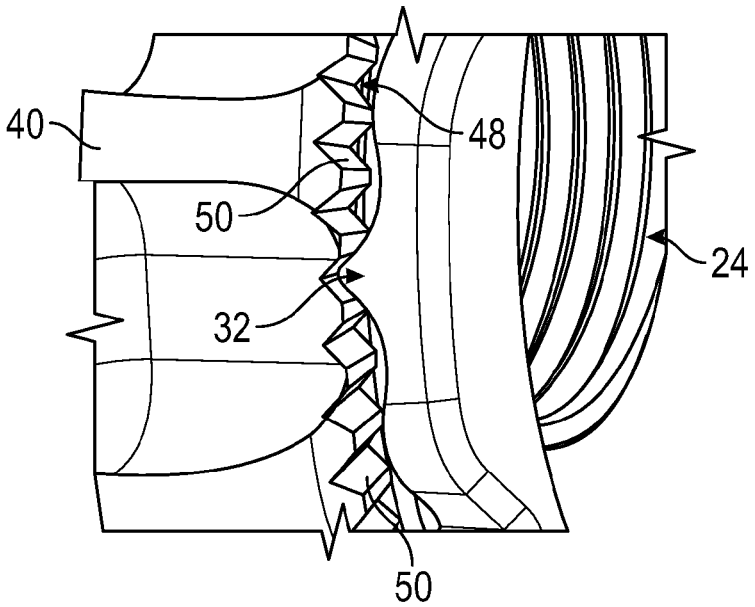
FIG. 5 is an enlarged, perspective view of a retention mechanism of the system of FIG. 1.

Rotating the adapter apparatus 14 and accessory brings the annular grooved surface 48 of the ratchet retainer ring 40 into engagement with the teeth or projections 32 adjacent to the first end 20 of the muzzle device 12, and compresses the spring 42 between the retaining ring 40 and the shoulder 60 of the adapter 44. Importantly, during this tightening, the ratchet retainer ring 40 is permitted to travel axially relative to the adapter 14 (due to the engagement of the lugs within the distal legs of the channels 64 that are axially oriented). The spring 42 biases the ratchet retainer ring 40 against the projections 32, with each projection 32 being held in engagement with a corresponding groove 50 of the annular grooved surface 48 of the ratchet retainer ring 40 (see FIG. 5). Accordingly, each successive rotation of the adapter 44 and accessory requires more and more force to overcome the bias of the spring 42 and allow the teeth 32 to seat into the next groove 50.

The rotation of accessory and adapter apparatus 14 continues until the tapered surface 66 of the adapter 44 abuts the tapered surface 34 of the muzzle device 12. The abutment of the tapered surfaces 34, 66 provides a user with a clear indication that the accessory attachment is complete and prevents over-tightening, thus avoiding possible damaging of the coarse-threaded portions and/or complicating subsequent removal of the accessory (and associated adapter 14). In addition, the abutment of the tapered surfaces 34, 66 forms a gas seal, which impedes hot gases generated during discharge of the firearm from reaching the male and female coarse threaded portions 30, 70. Accordingly, potentially harmful deposits are prevented from collecting on the male and female coarse threaded portions 30, 70. Additionally, the tapered surfaces 34, 66 provide for an automatic centering feature, ensuring that the accessory remains concentric to the firing axis 18 to reduce the possibility of a projectile coming in contact with the accessory during discharge of the firearm.

It will be appreciated from the above-description that the use of coarse-threaded portions 30, 70 allows for quick and easy removal and attachment of a silencer, or other muzzle attachment/accessory. In particular, in an embodiment, the coarse threaded portions 30, 70 include approximately three threads and, more preferably, two threads, such that only approximately three (and more preferably two) rotations are required to secure the adapter apparatus 14 and accessory to the muzzle device 12 (and to remove the adapter apparatus and accessory from the muzzle device 12).

Importantly, the grooved surface engagement mechanism (i.e., the engagement of the teeth 32 within the grooves 50 of the annular grooved surface 48 of the ratchet retainer ring 40) produces sufficient force to overcome any torsional forces acting on the accessory during operation the firearm with the accessory in place, while requiring minimal force to manually overcome the engagement and remove the accessory. Importantly, the wave spring 42 provides a continuous rearward force on the ratchet retainer ring 40 such that, even with vibrations, the accessory and adapter will maintain their attachment and alignment to the firearm.

Although the present invention has been described with reference to attaching a silencer to the muzzle of a firearm, it will be appreciated by those skilled in the art that the attachment system of the present invention is equally adaptable to any of a variety of other common muzzle attachments or accessories, such as those listed above, without departing from the scope of the invention. In addition, while the muzzle device 12 used in the muzzle attachment system 10 of the present invention is shown as a flash suppressor, it will be appreciated that, within the scope of the present invention, muzzle devices with other features and capabilities are advantageously employable, and that the muzzle device need not include a flash suppressor.

Additionally, the present invention is not limited to any particular means for attaching the muzzle device 12 to the distal end of the firearm barrel. One advantageous means includes complementary fine threads on the distal end of the firearm barrel and in an engagement portion of the muzzle device 12.

While the use of two opposed teeth 32 on the muzzle device 12 has been found optimal for engaging the annular grooved surface 48 of the retainer ring 40 and ensuring proper alignment of the accessory relative to the firing axis 18, more or less teeth can be used, although at least two teeth 32 are preferred. In addition, in the preferred embodiment, the teeth 32 are evenly distributed about the muzzle device 12. Alternatively, the muzzle device 12 may contain an annular grooved surface for receiving teeth formed on the ratchet retainer ring 40. Additionally, other complementary shapes for teeth 32 and grooves 50 fall within the scope of the present invention. For instance, knurling or complementary hemispherical cavities and protrusions may also be employed, without departing from the broader aspects of the present invention.

Importantly, incorporating the wave spring 42 into the adapter apparatus 14 that is normally separate from the muzzle device 12 and firearm when an accessory is not in use prevents the spring from being exposed to substantial heat cycling which could shorten the life of the apparatus 14 due to a reduction in shear modulus and metal fatigue (typically, an accessory such as a silencer will see limited deployment when compared to the overall use of the firearm itself). This is in contrast to existing devices that may incorporate various dynamic components (such as biasing springs) into the muzzle device itself. Where such dynamic components are always present on the muzzle device, they will be constantly exposed to heat cycling due to firearm use, even where no accessory is attached to the firearm.

As such, by incorporating the wave spring into the adapter apparatus 14 that is separate from the firearm when an accessory is not in use, such fatigue due to heat cycling can be substantially reduced, thereby increasing the useful life of the system 10 as compared to existing systems and devices. In addition, incorporating the wave spring into the adapter apparatus 14 prevents unnecessary components on the firearm itself when the accessory is not in use.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A system for attaching an accessory to a firearm, comprising:

a muzzle device configured for attachment to the muzzle end of a barrel of the firearm, the muzzle device having a first engagement means and one of an annular grooved surface and a grooved surface engagement mechanism; and an adapter device including:

an adapter having a forward portion including an accessory engagement means for receiving the accessory and a rearward portion having a second engagement means formed on an inner surface of the adapter;

a biasing mechanism received on the rearward portion; and a retainer ring received on the rearward portion adjacent to the biasing mechanism, the retainer ring having the other of the annular grooved surface and the grooved surface engagement mechanism;

wherein the first engagement means and the second engagement means cooperate to releasably secure the adapter device to the muzzle device;

wherein the biasing mechanism is configured to axially bias the retainer ring away from the forward portion of the adapter and towards the one of the annular grooved surface and the grooved surface engagement mechanism of the muzzle device so that the one of the annular grooved surface and the grooved surface engagement mechanism of the muzzle device engages the other of the annular grooved surface and the grooved surface engagement mechanism of the retainer ring; and wherein the retainer ring includes a plurality of lugs extending radially inward from an inner surface of the retainer ring; and the rearward portion of the adapter includes a plurality of channels configured to receive the lugs of the retainer ring.

2. The system of claim 1, wherein:

the muzzle device includes a first tapered surface rearward of the first engagement means; and the inner surface of the adapter includes a second tapered surface rearward of the second engagement means;

wherein the first and second tapered surfaces cooperate to form a gas seal when the adapter device is secured to the muzzle device.

3. The system of claim 1, wherein:

the annular grooved surface includes a plurality of grooves; and the grooved surface engagement mechanism includes at least one tooth configured to be received in one of the grooves of the annular grooved surface.

4. The system of claim 3, wherein:

the biasing mechanism is a wave spring.

5. The system of claim 1, wherein:

the plurality of channels are configured such that the retainer ring is permitted to move axially along the rearward portion of the adapter.

6. The system of claim 5, wherein:

the accessory is a silencer; and the muzzle device is a flash suppressor.

7. The system of claim 6, wherein:

the accessory engagement means is a plurality of fine threads.

8. An apparatus for attaching an accessory to a firearm, comprising:

an adapter having a generally cylindrical body having a forward portion including an accessory engagement means for receiving the accessory, and a rearward portion having a engagement means formed on an inner surface thereof;

a retainer ring received on the rearward portion and having one of an annular grooved surface and a grooved surface engagement mechanism; and a biasing mechanism received on the rearward portion of the adapter intermediate the accessory engagement means and the retainer ring, the biasing mechanism being configured to bias the retainer ring away from the forward portion;

wherein the engagement means is configured to cooperate with a corresponding engagement means of a muzzle device secured to a distal end of a firearm barrel to releasably secure the apparatus to the muzzle device;

wherein the inner surface of the adapter includes a tapered surface rearward of the engagement means;

wherein the tapered surface is configured to cooperate with a corresponding tapered surface of the muzzle device to form a gas seal when the apparatus is secured to the muzzle device;

wherein the muzzle device includes the other of the annular grooved surface and the grooved surface engagement mechanism; wherein the annular grooved surface includes a plurality of grooves; and wherein the grooved surface engagement mechanism includes at least one tooth configured to be received in one of the grooves of the annular grooved surface.

9. The apparatus of claim 8, wherein:

the biasing mechanism is a wave spring.

10. The apparatus of claim 8, wherein:

the retainer ring includes a plurality of lugs extending radially inward from an inner surface of the retainer ring; and the rearward portion of the adapter includes a plurality of channels configured to receive the lugs of the retainer ring therein.

11. The apparatus of claim 10, wherein:

the channels are configured such that the retainer ring is permitted to move axially along the rearward portion of the adapter.

12. The system of claim 8, wherein:

the accessory is a silencer; and the muzzle device is a flash suppressor.

13. The system of claim 8, wherein:

the accessory engagement means is a plurality of fine threads.

14. A method for attaching an accessory to a firearm, comprising the steps of:

securing a muzzle device to a barrel of a firearm, the muzzle device including a first engagement means and one of an annular grooved surface and a grooved surface engagement mechanism; and securing the accessory to an adapter device, the adapter device including a generally cylindrical body having a rearward portion having a second engagement means formed on an inner surface of the body, a biasing mechanism received on the rearward portion, and a retainer ring received on the rearward portion adjacent to the biasing mechanism, the retainer ring having the other of the annular grooved surface and the grooved surface engagement mechanism;

securing the adapter device, via the second engagement means, to the muzzle device; and forming a gas seal between the adapter device and the muzzle device;

wherein when the adapter device is secured to the muzzle device, the biasing mechanism axially biases the retainer ring away from the accessory and towards the one of the annular grooved surface and the grooved surface engagement mechanism of the muzzle device so that one of the annular grooved surface and the grooved surface engagement mechanism of the muzzle device engages the other of the annular grooved surface and the grooved surface engagement mechanism of the retainer ring; and wherein the retainer ring includes a plurality of lugs extending radially inward from an inner surface of the retainer ring; and the rearward portion of the adapter includes a plurality of channels configured to receive the lugs of the retainer ring.

15. The method according to claim 14, further comprising the steps of wherein:

securing the adapter device to the muzzle device includes sliding the adapter device over the muzzle device until the second engagement means abuts the first engagement means; and rotating the accessory and the adapter device about a firing axis of the firearm to bring the annular grooved surface into engagement with the grooved surface engagement mechanism.

* * * * *